US010850500B2

(12) United States Patent
Arakawa et al.

(10) Patent No.: US 10,850,500 B2
(45) Date of Patent: Dec. 1, 2020

(54) IMAGE FORMING SYSTEM

(71) Applicant: BROTHER KOGYO KABUSHIKI KAISHA, Nagoya (JP)

(72) Inventors: Yuta Arakawa, Nagoya (JP); Keisuke Wakakusa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/575,631

(22) Filed: Sep. 19, 2019

(65) Prior Publication Data

US 2020/0101719 A1 Apr. 2, 2020

(30) Foreign Application Priority Data

Sep. 28, 2018 (JP) ..... 2018-184137

(51) Int. Cl.
*B41J 2/045* (2006.01)
*B41J 13/08* (2006.01)
*B41J 13/00* (2006.01)

(52) U.S. Cl.
CPC ..... *B41J 2/04503* (2013.01); *B41J 2/045* (2013.01); *B41J 2/04505* (2013.01); *B41J 13/0009* (2013.01); *B41J 13/08* (2013.01)

(58) Field of Classification Search
CPC .... B41J 2/045; B41J 2/04503; B41J 2/04505; B41J 13/0009; B41J 13/08
See application file for complete search history.

(56) References Cited

U.S. PATENT DOCUMENTS 5,907,336 A * 5/1999 Hayakawa ..... 347/29
2013/0257934 A1* 10/2013 Chiba ..... 347/7
2013/0257953 A1* 10/2013 Iesaki ..... B41J 2/04501

FOREIGN PATENT DOCUMENTS

JP S58-108182 A 6/1983

* cited by examiner

*Primary Examiner* — Juanita D Jackson

(74) *Attorney, Agent, or Firm* — Scully, Scott, Murphy & Presser, PC

(57) ABSTRACT

A controller is configured to determine which of a first position and a second position is located at a farther downstream side in a moving direction of an ejector and to set a determined position as a turn position. The first position is a first distance away from an image formation end position in the moving direction. The second position is a second distance away from an image formation start position in the moving direction. The image formation end position is an end position of image formation onto a sheet in a conveyance process of the ejector before turning at the turn position. The image formation start position is a start position of image formation onto the sheet in a conveyance process of the ejector after turning at the turn position. The second distance is longer than the first distance.

9 Claims, 9 Drawing Sheets

IMAGE FORMING SYSTEM

CROSS REFERENCE TO RELATED APPLICATIONS

This application claims priority from Japanese Patent Application No. 2018-184137 filed Sep. 28, 2018. The entire content of the priority application is incorporated herein by reference.

TECHNICAL FIELD

This disclosure relates to an image forming system.

BACKGROUND

As an image forming system, an inkjet printer that forms an image on a sheet by ejecting ink is conventionally known. A well-known inkjet printer forms an image on a sheet by reciprocating a carriage on which an inkjet head is mounted along a main scanning direction and by intermittently conveying the sheet in a sub-scanning direction.

SUMMARY

According to one aspect, this specification discloses an image forming system. The image forming system includes an ejector, a first conveyor, a second conveyor, and a controller. The ejector is configured to eject ink toward a sheet. The first conveyor is configured to cause the ejector to reciprocate along a main scanning direction. The second conveyor is configured to convey the sheet in a sub-scanning direction. The controller is configured to repeatedly perform operations of controlling the first conveyor to convey the ejector along the main scanning direction to a turn position at which the ejector is stopped for turning, controlling the ejector to eject ink toward the sheet in a conveyance process of the ejector, and controlling the second conveyor to convey the sheet in the sub-scanning direction by a particular amount after ejection of ink by the ejector ends, thereby forming an image on the sheet. The controller is configured to determine which of a first position and a second position is located at a farther downstream side in a moving direction of the ejector and to set a determined position as the turn position. The first position is a first distance away from an image formation end position in the moving direction. The second position is a second distance away from an image formation start position in the moving direction. The image formation end position is an end position of image formation onto the sheet in a conveyance process of the ejector before turning at the turn position. The image formation start position is a start position of image formation onto the sheet in a conveyance process of the ejector after turning at the turn position. The second distance is longer than the first distance.

BRIEF DESCRIPTION OF THE DRAWINGS

Embodiments in accordance with this disclosure will be described in detail with reference to the following figures wherein.

DETAILED DESCRIPTION

Reciprocation of the carriage includes a process of decelerating the carriage and stopping the carriage at a turn position and a process of accelerating the carriage from the turn position. In an inkjet printer, normally, the carriage needs to be in a constant velocity state during image formation on a sheet. In this case, deceleration is not performed until the carriage passes the image formation end position. Acceleration is performed to complete by the time the carriage reaches the next image formation start position.

Conventionally, it is assumed that a deceleration distance necessary for stopping the carriage in a constant velocity state is the same as an acceleration distance necessary for shifting the carriage in a stopped state to the constant velocity state, and the turn position is determined so as to satisfy the above-mentioned condition.

Specifically, in a case where the image formation end position is located farther downstream than the next image formation start position in a carriage conveyance direction, the turn position is set to a position away from the image formation end position by a particular distance in the carriage conveyance direction. In a case where the next image formation start position is located farther downstream than the image formation end position in the conveyance direction, the turn position is set to a position away from the next image formation start position by the above-mentioned particular distance in the same direction.

However, in this setting method of the turn position, there is a case where the turn position is set to a position farther away from the image formation end position and the image formation start position than necessary.

In view of the foregoing, an aspect of an object of this disclosure is to reciprocate an ejector efficiently and improve throughput of image formation.

Some aspects of this disclosure will be described while referring to the attached drawings.

First Embodiment

Figure 1:
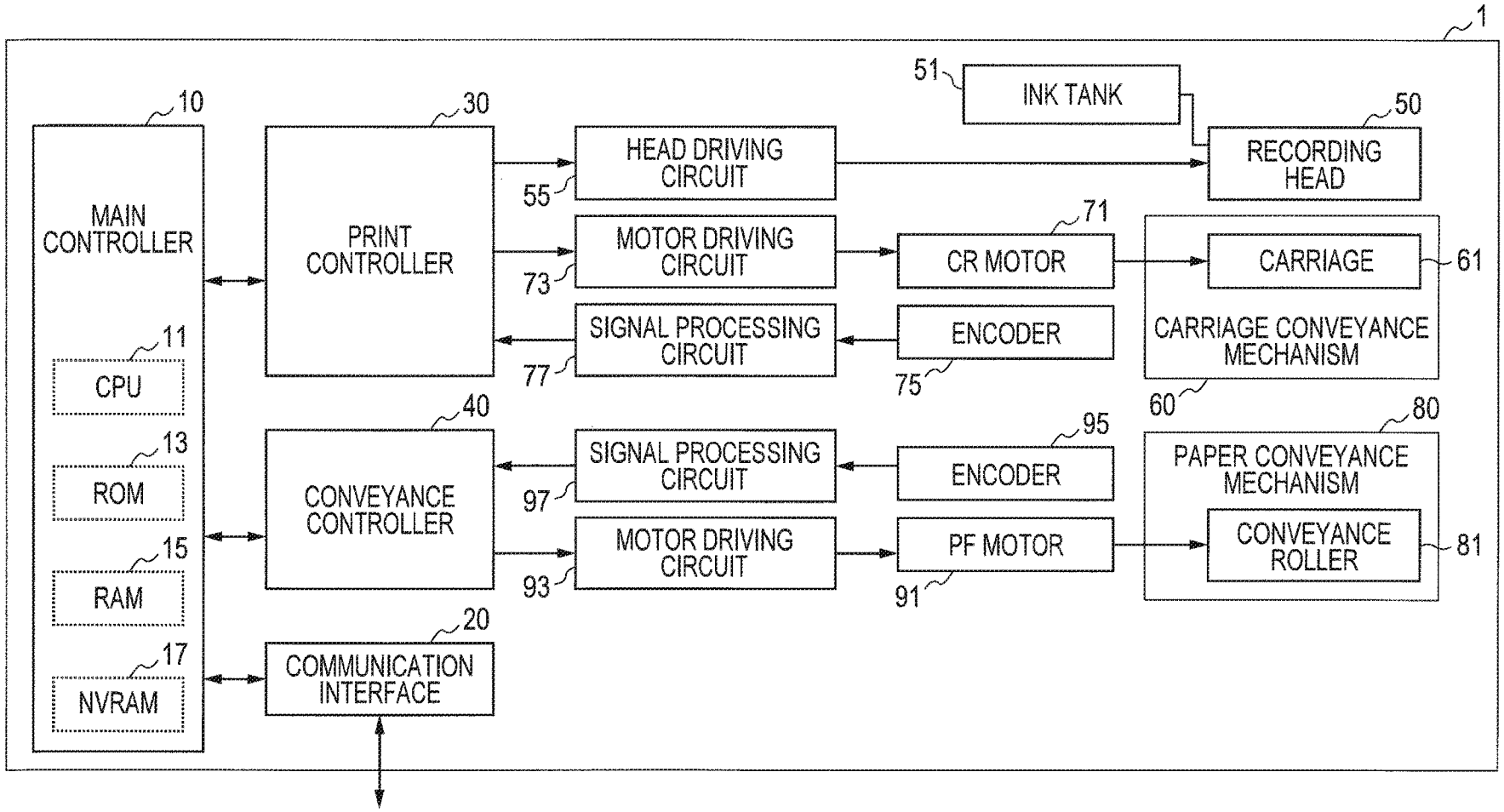
FIG. 1 is a block diagram showing the configuration of an image forming system.

An image forming system 1 of the present embodiment shown in FIG. 1 is configured as an inkjet printer. The image forming system 1 includes a main controller 10, a communication interface 20, a print controller 30, and a conveyance controller 40.

The main controller 10 includes a CPU 11, a ROM 13, a RAM 15, and an NVRAM 17. The ROM 13 stores programs. The CPU 11 executes processing in accordance with the programs stored in the ROM 13, thereby performs overall control of each section in the image forming system 1.

The RAM 15 is used as a work area when the CPU 11 executes processing. The NVRAM 17 is an electrically rewritable memory and may be a flash memory or an EEPROM. The NVRAM 17 stores data that needs to be kept even during power off.

The communication interface 20 is configured to perform data communication with an external apparatus, and receives print target data from the external apparatus, for example. In accordance with commands from the main controller 10, the print controller 30 controls conveyance of a carriage 61 on which a recording head 50 is mounted, and further controls an ink ejection operation by the recording head 50. Due to this control, the print controller 30 forms an image based on print target data on paper Q. In one example, the print controller 30 and the conveyance controller 40 are formed as an ASIC.

As elements relating to an image formation operation, the image forming system 1 includes the recording head 50, an ink tank 51, a head driving circuit 55, a carriage conveyance mechanism 60, a CR (carriage) motor 71, a motor driving circuit 73, an encoder 75, and a signal processing circuit 77 in addition to the print controller 30.

The recording head 50 is an inkjet head that ejects ink toward paper Q. The recording head 50 is mounted on the carriage 61. The recording head 50 is connected to the ink tank 51 that is not mounted on the carriage 61 through an ink supply line, and operates by receiving ink supply from the ink tank 51. The recording head 50 is also connected to a signal line.

The head driving circuit 55 is configured to drive the recording head 50 in accordance with control signals inputted from the print controller 30. The carriage conveyance mechanism 60 is configured to cause the carriage 61 to reciprocate along the main scanning direction by transmitting power from the CR motor 71 to the carriage 61. The detailed configuration of the carriage conveyance mechanism 60 will be described while referring to FIG. 2.

The CR motor 71 may be a direct-current motor. The motor driving circuit 73 drives the CR motor 71 by PWM control. Specifically, the motor driving circuit 73 applies, to the CR motor 71, a drive current in accordance with an input signal from the print controller 30, and drives the CR motor 71.

The encoder 75 is a linear encoder configured to output encoder signals depending on displacement of the carriage 61 in the main scanning direction. The signal processing circuit 77 detects the position and velocity of the carriage 61 in the main scanning direction, based on encoder signals inputted from the encoder 75. The position and velocity of the carriage 61 detected by the signal processing circuit 77 are inputted to the print controller 30.

The print controller 30 determines a manipulated variable for the CR motor 71 such that the carriage 61 moves in accordance with a target position and a velocity locus that follows a command from the main controller 10, based on the position and velocity of the carriage 61 inputted from the signal processing circuit 77, and inputs a corresponding control signal to the motor driving circuit 73. With this operation, the print controller 30 controls the CR motor 71 so as to realize conveyance control that follows the command from the main controller 10.

Further, the print controller 30 inputs, to the head driving circuit 55, a control signal for realizing ink ejection control corresponding to input data from the main controller 10, based on the position of the carriage 61 inputted from the signal processing circuit 77. With this operation, the recording head 50 ejects ink, onto paper Q, for forming an image corresponding to print target data at appropriate timing.

The conveyance controller 40 controls a PF (paper feed) motor 91 in accordance with commands from the main controller 10, thereby controlling conveyance of paper Q. As elements relating to conveyance of paper Q, the image forming system 1 includes a paper conveyance mechanism 80, the PF motor 91, a motor driving circuit 93, an encoder 95, and a signal processing circuit 97.

The paper conveyance mechanism 80 receives power from the PF motor 91 and causes a conveyance roller 81 to rotate, thereby conveying paper Q in a sub-scanning direction perpendicular to the main scanning direction. With this operation, the paper conveyance mechanism 80 feeds paper Q, by a particular amount at a time, to a position in the sub-scanning direction at which the recording head 50 reciprocates.

The PF motor 91 may be a direct-current motor. The motor driving circuit 93 applies, to the PF motor 91, a drive current in accordance with an input signal from the conveyance controller 40, thereby driving the PF motor 91.

The encoder 95 is a rotary encoder provided at a rotational shaft of the PF motor 91 or the conveyance roller 81 and configured to output encoder signals depending on rotation of the PF motor 91 or the conveyance roller 81.

The signal processing circuit 97 detects a rotation amount and a rotation velocity of the conveyance roller 81 based on the encoder signal inputted from the encoder 95. The rotation amount and the rotation velocity of the conveyance roller 81 correspond to the conveyance amount and the conveyance velocity of paper Q conveyed due to rotation of the conveyance roller 81.

The rotation amount and the rotation velocity detected by the signal processing circuit 97 are inputted to the conveyance controller 40. The conveyance controller 40 determines a manipulated variable for the PF motor 91 based on the rotation amount and the rotation velocity detected by the signal processing circuit 97, and controls the PF motor 91. With this operation, the conveyance controller 40 controls rotation of the conveyance roller 81, thereby controlling conveyance of paper Q.

Figure 2:
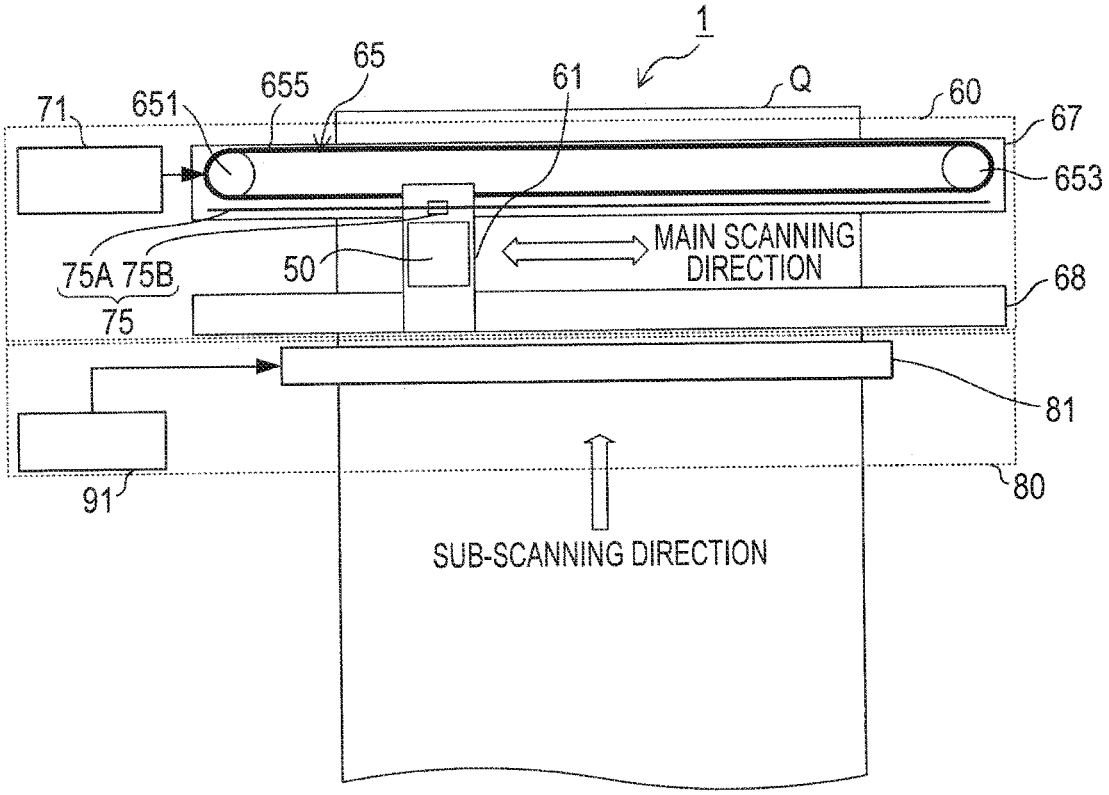
FIG. 2 is a diagram showing the configuration of a carriage conveyance mechanism and a paper conveyance mechanism.

As shown in FIG. 2, the carriage conveyance mechanism 60 includes the carriage 61, a belt mechanism 65, and guide rails 67, 68. The belt mechanism 65 includes a drive pulley 651 and a follow pulley 653 arranged in the main scanning direction, and a belt 655 looped between the drive pulley 651 and the follow pulley 653. The carriage 61 is fixed to the belt 655. In the belt mechanism 65, the drive pulley 651 rotates by receiving power from the CR motor 71, and the belt 655 and the follow pulley 653 rotate by following rotation of the drive pulley 651.

The guide rails 67, 68 extend along the main scanning direction, and arranged at positions away from each other in the sub-scanning direction. The belt mechanism 65 is disposed at the guide rail 67. For example, a protruding wall (not shown) extending along the main scanning direction is formed on the guide rails 67, 68 in order to regulate the movement direction of the carriage 61 in the main scanning direction.

In a state where the movement direction of the carriage 61 is regulated by the guide rails 67, 68, the carriage 61 reciprocates on the guide rails 67, 68 along the main scanning direction in conjunction with rotation of the belt 655. The recording head 50 is mounted on the carriage 61, and moves in the main scanning direction due to movement of the carriage 61.

The conveyance roller 81 is arranged to be parallel with the main scanning direction at an upstream side of the recording head 50 in the sub-scanning direction. The conveyance roller 81 rotates by receiving power from the PF motor 91 and, by this rotation, conveys paper Q conveyed from the upstream side to the downstream side in the sub-scanning direction.

Specifically, the conveyance roller 81 is indirectly controlled by the conveyance controller 40 through the PF motor 91, and intermittently and repeatedly executes an operation of rotating by a particular amount, thereby conveying paper Q to the downstream side in the sub-scanning direction by a particular amount at a time. The paper conveyance mechanism 80 includes a paper feed roller (not shown) at the upstream side of the conveyance roller 81. The paper feed roller picks up paper Q from a tray and conveys the paper Q to the downstream side.

As shown in FIG. 2, the encoder 75 includes an encoder scale 75A and an optical sensor 75B. The encoder scale 75A is disposed at the guide rail 67 along the main scanning direction. The optical sensor 75B is mounted on the carriage 61. The encoder 75 inputs, to the signal processing circuit 77, encoder signals depending on change of a relative position between the encoder scale 75A and the optical sensor 75B.

Figure 3:
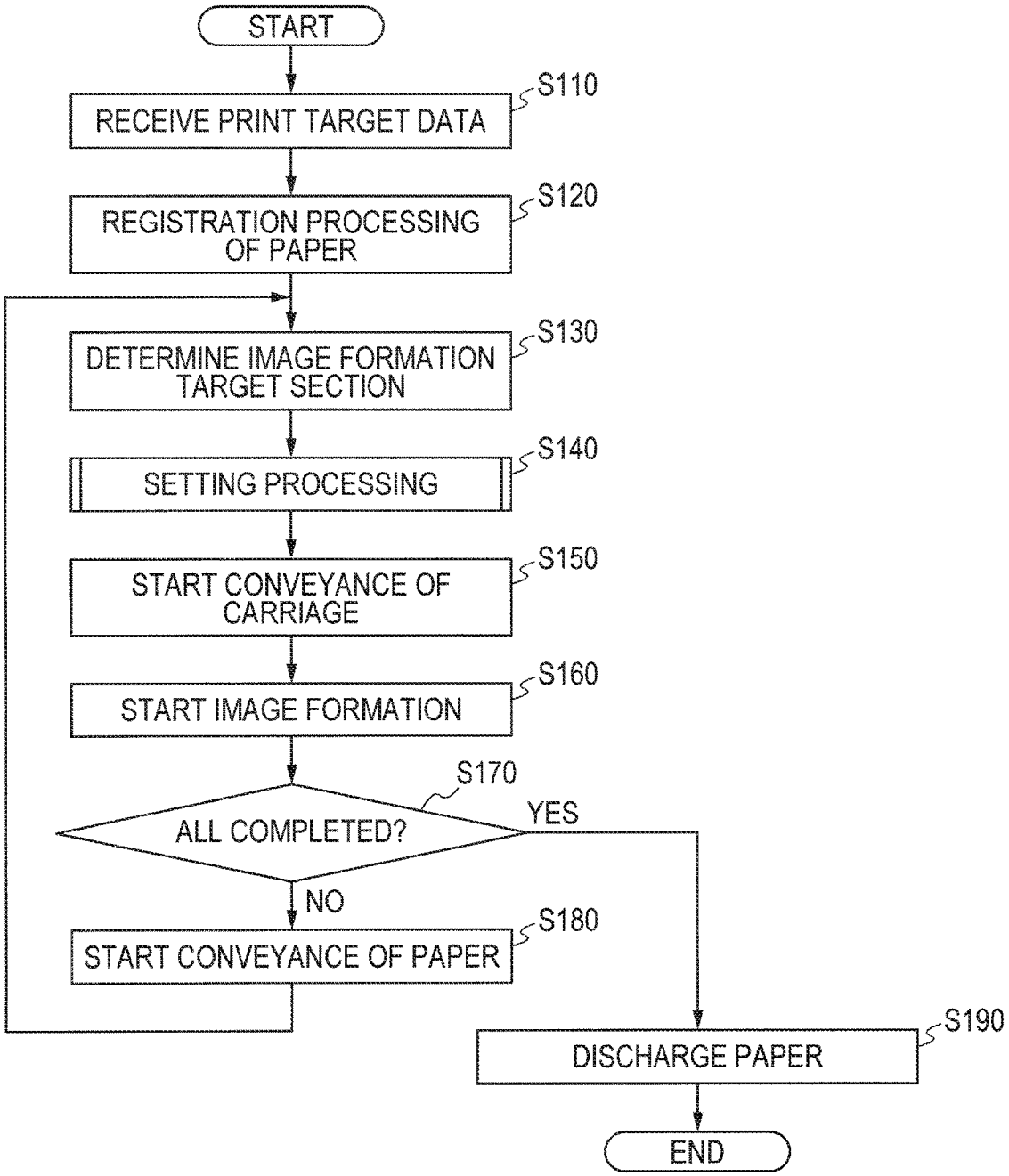
FIG. 3 is a flowchart showing processing that is executed by a main controller in response to receiving a print command.

Next, the details of processing executed by the main controller 10 in response to receiving a print command from the external apparatus through the communication interface 20 will be described while referring to FIG. 3. As shown in FIG. 3, in response to receiving a print command, the main controller 10 receives print target data from the external apparatus (S110), and executes registration processing of paper Q (S120).

In registration processing, the main controller 10 inputs a command to the conveyance controller 40 such that the paper conveyance mechanism 80 conveys paper Q to the downstream side in the sub-scanning direction and a leading end of an image formation target region of paper Q in the sub-scanning direction is located below the recording head 50.

The main controller 10 sets, to the conveyance controller 40, a target profile indicative of the target position and the velocity locus of the conveyance roller 81, and causes the conveyance controller 40 to control the PF motor 91 such that the conveyance roller 81 rotates in accordance with the position and the velocity locus that follow the target profile, thereby realizing registration of paper Q.

In response to completing the registration processing, in the following S130-S180, the main controller 10 forms an image based on print target data on paper Q by repeatedly performing operations of causing the carriage conveyance mechanism 60 to convey the recording head 50 to the turn position by one pass along the main scanning direction, in the conveyance process of the recording head 50, causing the recording head 50 to eject ink toward paper Q in a stopped state, and, after the recording head 50 ends ink ejection, causing the paper conveyance mechanism 80 to convey the paper Q by a particular amount in the sub-scanning direction.

That is, the main controller 10 forms an image based on print target data on paper Q by, while intermittently conveying the paper Q by the particular amount, causing, during a stop period of the paper Q, the recording head 50 to perform an image formation operation for one pass along the main scanning direction. The conveyance amount of paper Q during intermittent conveyance (the above-mentioned particular amount) corresponds to a width of an image, in the sub-scanning direction, formed by this image formation operation for one pass.

In the following description, the conveyance operation and image formation operation of the recording head 50 for one pass when forming an image on paper Q by reciprocation of the carriage 61 with intermittent conveyance of the paper Q are referred to as "conveyance operation for one pass" and "image formation operation for one pass".

That is, a conveyance operation for one pass of the recording head 50 (the carriage 61) corresponds to an operation of conveying the recording head 50 from the stop position to the turn position one way along the main scanning direction, and an image formation operation for one pass corresponds to an ink ejection operation that is performed during the conveyance operation for one pass of the recording head 50. The conveyance operation for one pass of paper Q corresponds to an operation of conveying paper Q to the downstream side in the sub-scanning direction by the particular amount, the operation being performed between an image formation operation for one pass and an image formation operation for the next one pass.

That is, in S130-S180, the main controller 10 sequentially forms, on paper Q, an image based on print target data by one pass at a time, by repeatedly performing the conveyance operation for one pass of the carriage 61, the image formation operation for one pass, and the conveyance operation for one pass of paper Q, which are overlapped partially.

In S130, the main controller 10 determines an image formation target section of the current pass and an image formation target section of the next pass based on print target data. The image formation target section of the current pass corresponds to a section in the main scanning direction in which an ink ejection operation is performed during the conveyance operation for one pass of the carriage 61 that is started immediately. The image formation target section of the next pass corresponds to a section in the main scanning direction in which an ink ejection operation is performed during the conveyance operation for one pass of the carriage 61 that is performed next time.

Specifically, the main controller 10 determines an image formation start position and an image formation end position as the image formation target section. The image formation start position corresponds to a position of the carriage 61 in the main scanning direction at which the recording head 50 starts an ink ejection operation, that is, an ink ejection start position. The image formation end position corresponds to a position of the carriage 61 in the main scanning direction at which the recording head 50 ends an ink ejection operation, that is, an ink ejection end position.

Upon ending processing in S130, the main controller 10 moves to S140 and executes setting processing of which details will be described later. In the setting processing, the main controller 10 sets a carriage stop position that is the turn position of the carriage 61, based on the image formation end position of the current pass and the image formation start position of the next pass.

Figure 4:
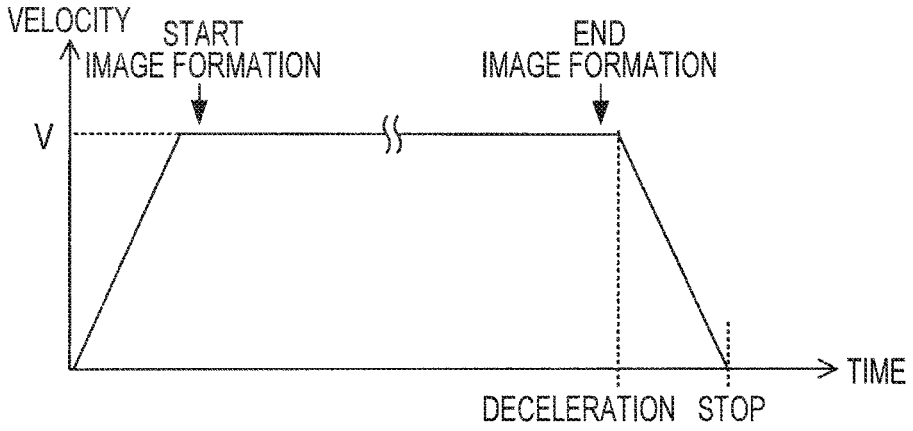
FIG. 4 is a graph of velocity with respect to time showing a velocity locus of the carriage.

In S150, the main controller 10 sets, to the print controller 30, a target profile indicative of the target position and the velocity locus, and, as shown in FIG. 4, for example, causes the print controller 30 to control the carriage conveyance mechanism 60 (the CR motor 71) such that the carriage 61 accelerates from the current position to a particular velocity V, then moves at the particular velocity V (constant velocity) to a deceleration start position, starts deceleration at the deceleration start position, and stops at a carriage stop position in accordance with the target profile.

In S160, the main controller 10 inputs, to the print controller 30, data necessary for the image formation operation of the current pass created from the print target data, and causes the print controller 30 to control the recording head 50 such that the recording head 50 performs an image formation operation for one pass corresponding to the current pass in the image formation target section from the image formation start position to the image formation end position. As in a known inkjet printer, in order to control an ink landing point on paper Q, an image formation operation (that is, an ink ejection operation) is performed on stopped paper Q in a state where the carriage 61 is conveyed at a constant velocity. That is, the image formation target section is within a constant-velocity conveyance section of the carriage 61.

After that, the main controller 10 determines whether image formation operations for a plurality of passes corresponding to print target data received in S110 are all completed in the last S160 processing (S170). In response to determining that the image formation operations are all completed (S170: Yes), the main controller 10 executes paper discharge processing (S190) after the conveyance operation and the image formation operation for one pass in S150 and S160 end. In the paper discharge processing, the conveyance controller 40 controls the PF motor 91 such that paper Q is discharged from the paper conveyance mechanism 80. Then, the processing shown in FIG. 3 ends.

In response to determining that the image formation operations are not completed (S170: No), the main controller 10 inputs a command to the conveyance controller 40 such that the paper conveyance mechanism 80 starts conveyance of paper Q in the sub-scanning direction by the particular amount when a conveyance start timing of paper Q has come (S180).

Specifically, the main controller 10 may set, to the conveyance controller 40, a target profile indicative of the target position and the velocity locus of the conveyance roller 81 for conveying paper Q by the particular amount, and cause the conveyance controller 40 to start control of the PF motor 91 that follows the set target profile when it is detected that the conveyance start timing of paper Q has come.

Detection that the conveyance start timing of paper Q has come may be realized by receiving information necessary for such detection from the print controller 30. The conveyance start timing of paper Q corresponds to timing at which the recording head 50 passes the image formation end position. The main controller 10 detects that the conveyance start timing of paper Q has come by acquiring positional information of the carriage 61 through the print controller 30.

After executing processing of S180, the main controller 10 moves to S130 and determines the image formation target section by the image formation operation for one pass executed in subsequent S160 and also the image formation target section of the next pass. After ending the setting processing (S140) based on these image formation target sections, the main controller 10 executes processing of S150 and causes the carriage conveyance mechanism 60 to start conveyance of the carriage 61.

In S150, in a case where the conveyance operation of paper Q started in the processing of immediately preceding S180 has not ended, the main controller 10 causes the carriage conveyance mechanism 60 to start conveyance of the carriage 61 before the conveyance operation of paper Q ends or at the timing when the conveyance operation of paper Q ends, such that the carriage 61 passes the image formation start position after the conveyance operation of paper Q ends.

In this way, the main controller 10 forms an image based on print target data on paper Q by repeatedly performing the conveyance operation of the carriage 61 for one pass, the image formation operation for one pass, and the conveyance operation of paper Q for one pass that are partially overlapped.

Figure 5:
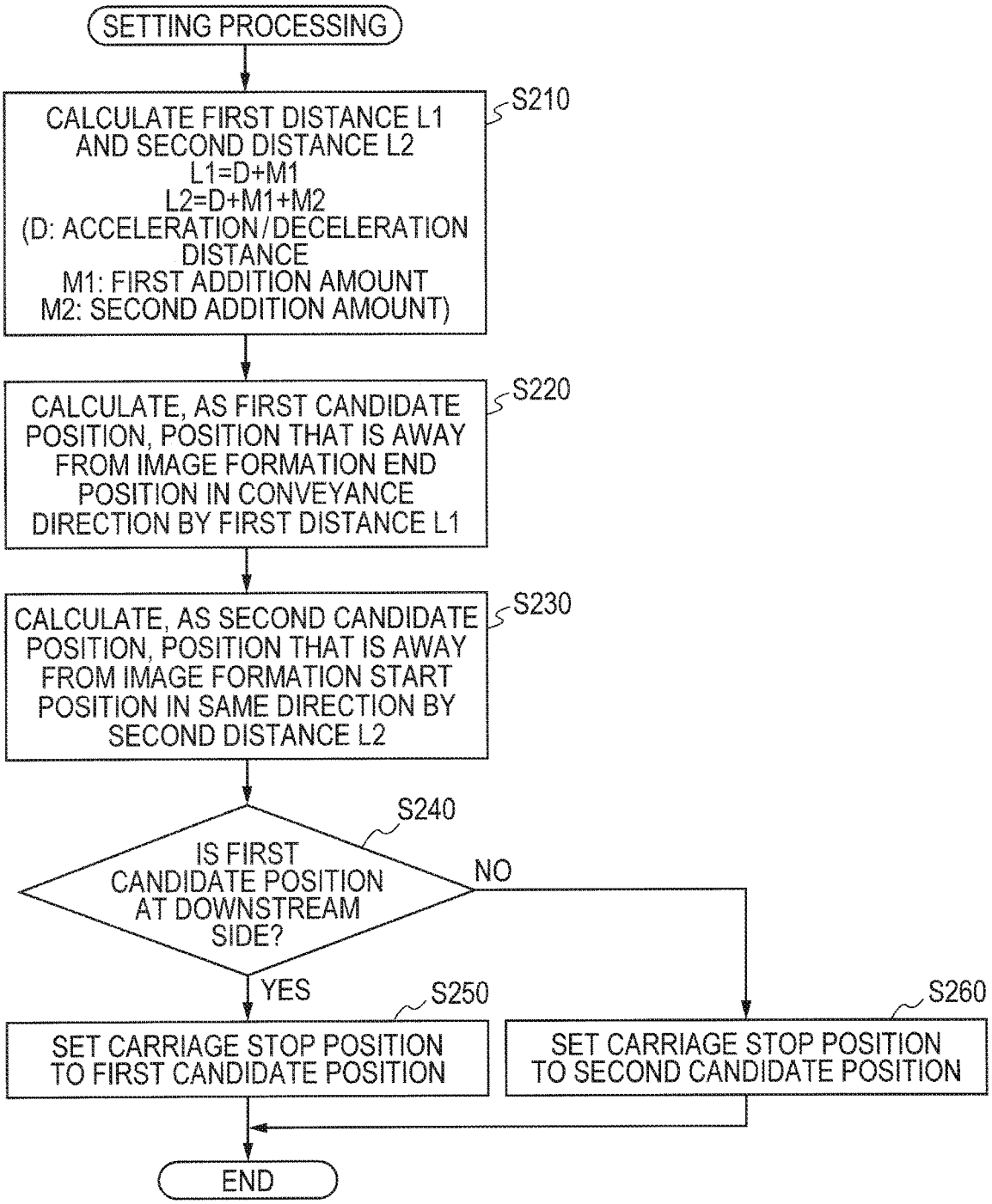
FIG. 5 is a flowchart showing setting processing that is executed by the main controller according to a first embodiment.

Next, details of the setting processing executed by the main controller 10 will be described while referring to FIGS. 5 to 7. Upon starting the setting processing, the main controller 10 calculates a first distance L1 and a second distance L2 in order to set an appropriate carriage stop position as the turn position of the carriage 61 in the conveyance process of the carriage 61 from the image formation end position of the current pass to the image formation start position of the next pass (S210).

The first distance L1 corresponds to a distance in which the carriage 61 decelerates and stops from the constant velocity state, and is calculated by an expression L1=D+M1. The second distance L2 corresponds to a distance in which the carriage 61 accelerates (shifts) from the carriage stop position to the constant velocity state, and is calculated by an expression L2=D+M1+M2.

The above-mentioned value D used for calculation of the first distance L1 and the second distance L2 is an acceleration and deceleration distance in design which does not consider a control error. The acceleration distance is a conveyance distance of the carriage 61 necessary for shifting the carriage 61 in a stopped state to a constant velocity state of the particular velocity V. The deceleration distance is a conveyance distance of the carriage 61 necessary for stopping the carriage 61 in the constant velocity state of the particular velocity V.

In the present embodiment, the target velocity locus at the time of acceleration and deceleration of the carriage 61 has a symmetrical shape. Thus, the acceleration distance is equal to the deceleration distance. It is preferable that the acceleration distance and the deceleration distance be set as short as possible within a feasible range in consideration of throughput of printing. In this case, the acceleration distance is normally equal to the deceleration distance. In the following description, the value D is also referred to as "acceleration-deceleration distance D". The acceleration-deceleration distance D may be defined as a value that is obtained by performing time integration on the target velocity locus of an acceleration period or a deceleration period indicated by the target profile for carriage conveyance.

In addition, in the present embodiment, the target velocity locus during acceleration and the target velocity locus during deceleration with respect to the velocity V in the constant velocity state are the same regardless of the carriage stop position. Adjustment of the carriage stop position is performed by adjusting the length of the constant velocity section.

A value M1 included in the expression corresponds to an error that can occur in an actual stop position of the carriage 61 relative to a set carriage stop position (target carriage stop position) when the carriage 61 is stopped at the set carriage stop position. In the following description, the value M1 is also referred to as "first addition value M1". The first addition value M1 is set to a maximum value of expected errors.

A value M2 included in the expression corresponds to a distance in which the carriage 61 moves from a point where the carriage 61 shifts to the constant velocity section until the constant velocity movement of the carriage 61 becomes stable. Specifically, the value M2 corresponds to a distance in which the carriage 61 moves from an acceleration end position in design that follows the target profile until the carriage 61 becomes stable at the constant velocity V. In the following description, the value M2 is also referred to as "second addition value M2". The first addition value M1 and the second addition value M2 are positive values. The first addition value M1 and the second addition value M2 are preliminarily determined by a designer, and stored in the NVRAM 17.

As can be understood from the above description, the first distance L1 corresponds to a distance in which the carriage 61 moves until the carriage 61 in the constant velocity state stops, and includes an error of the stop position. The second distance L2 corresponds to a movement distance of the carriage 61 in which the carriage 61 accelerates from the carriage stop position, shifts to the constant velocity state, and the velocity becomes stable.

Upon calculating the first distance L1 and the second distance L2, the main controller 10 calculates, as a first candidate position of the carriage stop position, a position away from the image formation end position of the current pass by the first distance L1 to the downstream side in the conveyance direction of the carriage 61 (S220).

The main controller 10 further calculates, as a second candidate position of the carriage stop position, a position away from the image formation start position of the next pass by the second distance L2 in the same direction as S220 (S230).

After that, the main controller 10 determines which of the first candidate position and the second candidate position is located at a farther downstream side in the conveyance direction of the carriage 61 in the current pass (S240). Specifically, the main controller 10 determines whether the first candidate position is located at a farther downstream side than the second candidate position in the conveyance direction (S240).

When a positive determination is made in S240 because the first candidate position is located at a farther downstream side than the second candidate position in the conveyance direction, the main controller 10 sets the carriage stop position to the first candidate position (S250). When a negative determination is made in S240, the main controller 10 sets the carriage stop position to the second candidate position (S260). Upon ending setting of the carriage stop position, the main controller 10 ends the setting processing.

Figure 6A:
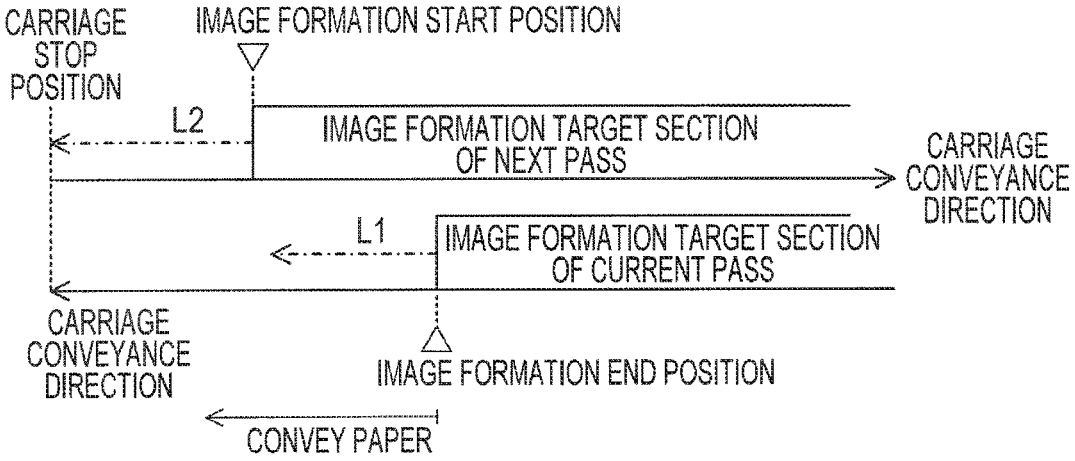
FIGS. 6A and 6B are explanatory diagrams relating to carriage stop positions.

As can be understood from the above, the second distance L2 is longer than the first distance L1. Thus, as shown in FIG. 6A, in a case where the image formation start position of the next pass is located at a farther downstream side than the image formation end position of the current pass in the conveyance direction of the carriage 61 of the current pass, the second candidate position is selected as the carriage stop position. The carriage stop position is set to a position away from the image formation start position of the next pass by the second distance L2.

Figure 6B:
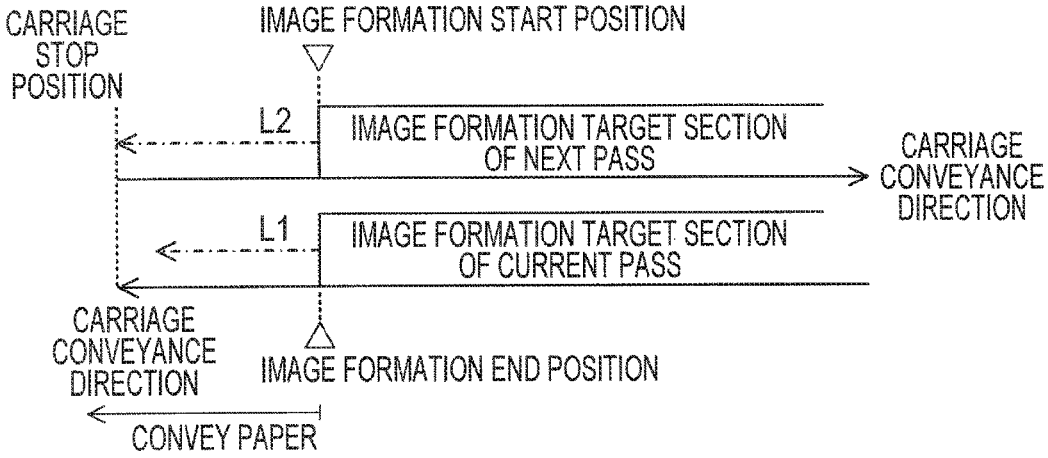

As shown in FIG. 6B, in a case where the image formation start position of the next pass is located at the same position as the image formation end position of the current pass in the main scanning direction, as well, the second candidate position is selected as the carriage stop position.

Figure 7:
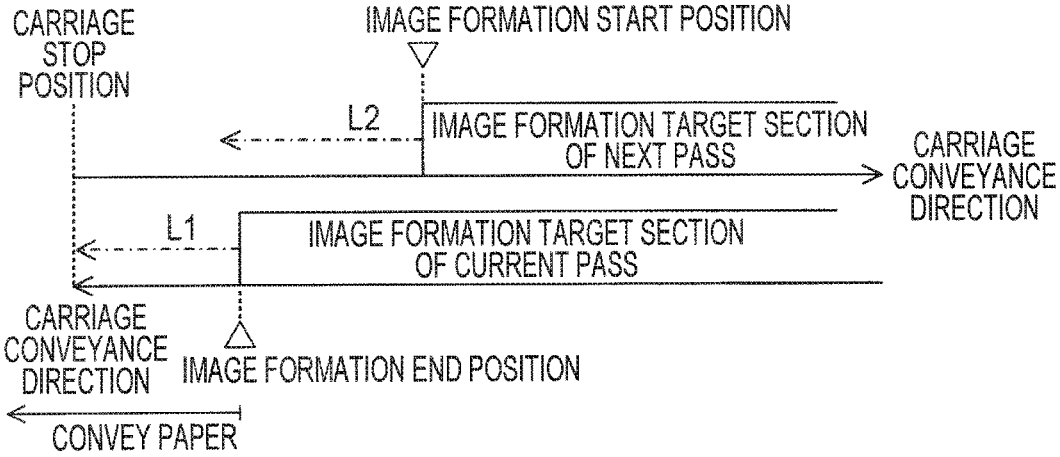
FIG. 7 is an explanatory diagram relating to a carriage stop position.

On the other hand, as shown in FIG. 7, in a case where the image formation end position of the current pass is located at a farther downstream side than the image formation start position of the next pass by a distance (L2−L1) or longer, the first candidate position is selected as the carriage stop position. The carriage stop position is set to a position away from the image formation end position of the current pass by the first distance L1. As can be understood from the above, the distance (L2−L1) corresponds to a distance that is necessary for movement of the carriage 61 to become stable at a constant velocity state.

In the processing of S150 to S180 based on the carriage stop position that is set in this way, a target profile for stopping the carriage 61 at this carriage stop position is generated, the carriage 61 is accelerated from the stop position to the particular velocity V by using this target profile, and then the recording head 50 starts an ink ejection operation at timing when the carriage 61 passes the image formation start position of the current pass in a constant velocity state, and the ink ejection operation is ended at timing when the carriage 61 passes the image formation end position.

Further, the paper conveyance mechanism 80 performs a conveyance operation of paper Q by the particular amount at timing when the carriage 61 passes the image formation end position, and the carriage 61 is decelerated at timing when the carriage 61 passes a deceleration start position that is an upstream side of the carriage stop position by the acceleration-deceleration distance D, so that the carriage 61 stops at the carriage stop position.

As described above, the carriage stop position is set such that constant velocity movement and conveyance control of the carriage 61 become stable by the time the carriage 61 reaches the image formation start position of the next pass. Thus, an ink ejection operation is performed on paper Q in a stable movement state from the image formation start position, and a high-quality image is formed on paper Q.

Also, in the present embodiment, as shown in FIG. 7, in a case where the image formation start position of the next pass is located at a farther upstream side than the image formation end position of the current pass by a length (L2−L1) or longer, the carriage stop position is set from the image formation end position of the current pass based on the first distance L1 that does not include a distance for the above-described "stabilization".

As described above, in the present embodiment, the carriage stop position in the conveyance process of the carriage 61 from the image formation end position to the next image formation start position is set based on the image formation end position and the image formation start position and based on the first distance L1 for deceleration and the second distance L2 for acceleration. Considering stability of the initial period of the constant velocity section, the second distance L2 includes a margin (first addition amount M1+second addition amount M2) that is larger than a margin (first addition amount M1) included in the first distance L1. Thus, according to the present embodiment, the carriage 61 is reciprocated efficiently while preventing degradation of quality of an image formed on paper Q, thereby providing the image forming system 1 having good throughput in printing.

In the present embodiment, the second distance L2 is longer than the first distance L1. This distance relationship (length relationship) has the following effects. For example, considering the quality of an image formed by ink ejection, it is preferable that conveyance control of the carriage 61 is stable when the carriage 61 reaches the image formation start position from the turn position. This stability is normally less important in conveyance control from the image formation end position at which ink ejection ends to the turn position.

By setting the second distance L2 to a longer length than the first distance L1, the second distance L2 includes a distance for the above-mentioned stability and, on the other hand, the first distance L1 does not include such distance for the stability. Thus, with this distance relationship, the carriage 61 (the recording head 50) can be reciprocated efficiently while maintaining good quality of an image formed on paper Q.

Second Embodiment

Next, an image forming system 1 of a second embodiment will be described. The image forming system 1 of the second embodiment is different from the image forming system 1 of the first embodiment in that the main controller 10 executes setting processing shown in FIG. 8 instead of the setting processing shown in FIG. 5, and the second embodiment is basically same as the first embodiment in other points. Thus, in the following description, the details of the setting processing executed by the main controller 10 will be described selectively.

Figure 8:
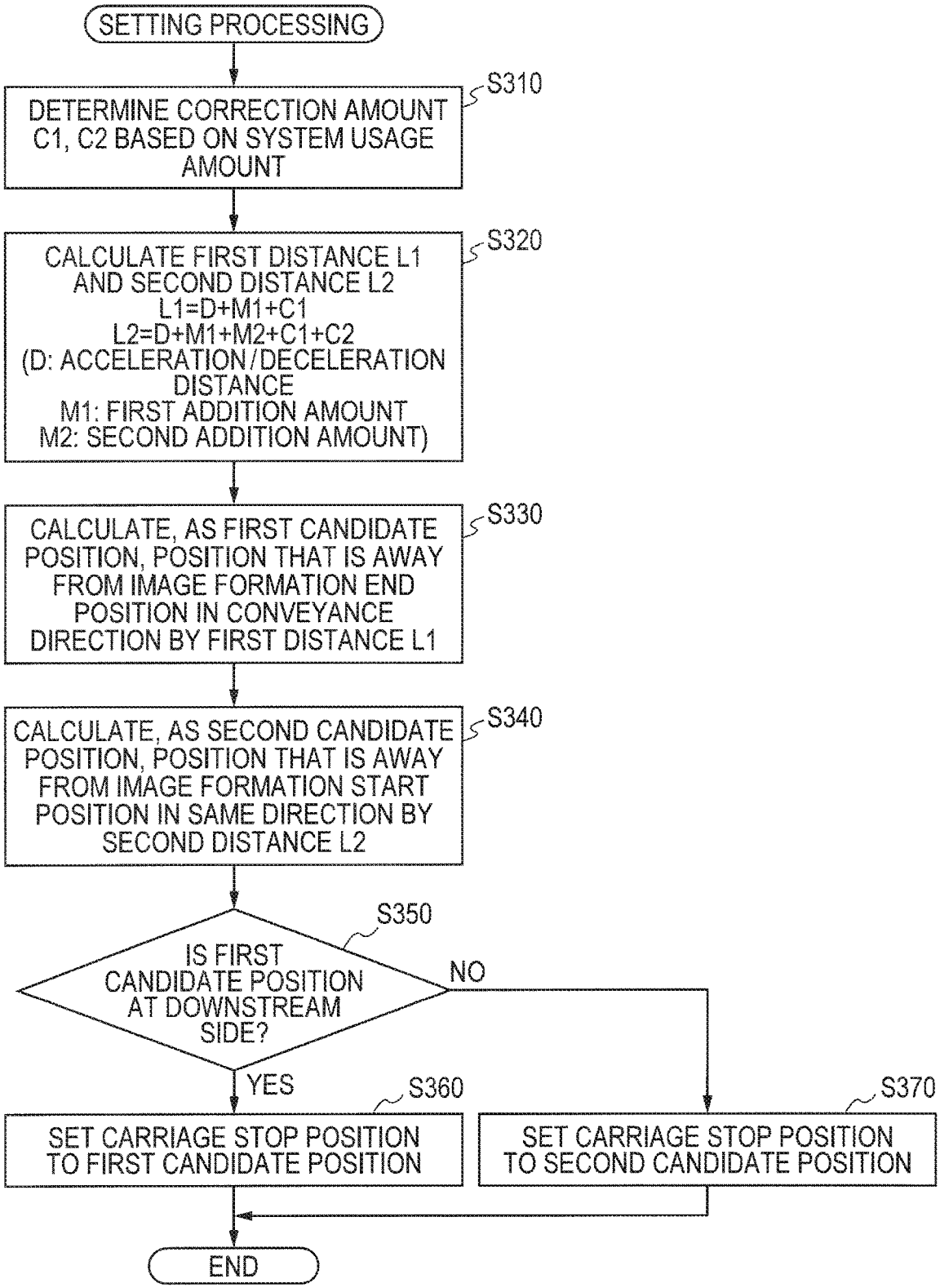
FIG. 8 is a flowchart showing setting processing according to a second embodiment.

Upon starting the setting processing shown in FIG. 8 in S140 (FIG. 3), the main controller 10 determines correction amounts C1, C2 of the first distance L1 and the second distance L2 for considering control accuracy that decreases due to usage of the image forming system 1 (S310).

The correction amount C1 is a correction amount for correcting the first addition amount M1 included in the first distance L1 and the second distance L2. The correction amount C2 is a correction amount for correcting the second addition amount M2 included in the second distance L2.

The correction amount C 1 and the correction amount C2 may be determined for each level of the system usage amount, and be stored in the NVRAM 17. A designer of the image forming system 1 may obtain, by experiments, appropriate values of the correction amount C1 and the correction amount C2 for each level of the system usage amount, and store, in the NVRAM 17, a table including the correction amount C1 and the correction amount C2 for each level of the system usage amount. As the system usage amount increases, the control accuracy normally decreases. Thus, as the system usage amount increases, the correction amount C1 and the correction amount C2 are defined as larger positive values.

The system usage amount may be one of a total operating time from the start of usage of the image forming system 1, a total number of printed sheets, a total conveyance distance of the carriage 61, and a total number of times of conveyance of the carriage 61. Alternatively, the system usage amount may be a value that is calculated based on two or more of the above-mentioned amounts. The main controller 10 may refer to the table stored in the NVRAM 17, and determine the correction amount C1 and the correction amount C2 based on the system usage amount.

After determining the correction amount C1 and the correction amount C2, the main controller 10 calculates the first distance L1 and the second distance L2 in accordance with the expression shown below (S320).

$$L1=D+M1+C1$$

$$L2=D+M1+M2+C1+C2$$

The values D, M1, M2 in the above expressions are the same as those in the first embodiment. That is, the first distance L1 calculated in the present embodiment corresponds to a value that is obtained by correcting the first distance L1 of the first embodiment with the correction amount C1 based on the system usage amount. The second distance L2 in the present embodiment corresponds to a value that is obtained by correcting the second distance L2 of the first embodiment with the correction amounts C1, C2 based on the system usage amount.

After that, the main controller 10 executes similar processing to S220-S260 in the first embodiment. That is, the main controller 10 calculates, as a first candidate position, a position away from the image formation end position of the current pass by the first distance L1 calculated in S320 to the downstream side in the conveyance direction of the carriage 61 (S330). The main controller 10 further calculates, as a second candidate position, a position away from the image formation start position of the next pass by the second distance L2 calculated in S320 in the same direction (S340).

Based on the first candidate position and the second candidate position calculated as described above, the main controller 10 determines whether the first candidate position is located at a farther downstream side than the second candidate position in the conveyance direction (S350). When a positive determination is made (S350: Yes), the carriage stop position is set to the first candidate position (S360). When a negative determination is made (S350: No), the carriage stop position is set to the second candidate position (S370). After that, the setting processing ends.

According to the present embodiment, in an environment in which the control accuracy of carriage conveyance changes depending on the usage amount of the image forming system 1, the first distance L1 and the second distance L2 are corrected based on the usage amount of the image forming system 1, and the carriage stop position is determined.

Thus, it is unnecessary to preliminarily include large margins in the first addition amount M1 and the second addition amount M2 in consideration of change of the control accuracy, and the carriage 61 can be reciprocated efficiently. Hence, according to the present embodiment, throughput of printing improves, and print time per sheet of paper is reduced.

Third Embodiment

Next, an image forming system 1 of a third embodiment will be described. The image forming system 1 of the third embodiment is different from the image forming system 1 of the first embodiment in that the main controller 10 executes setting processing shown in FIG. 9 instead of the setting processing shown in FIG. 5, and the third embodiment is basically same as the first embodiment in other points. Thus, in the following description, the details of the setting processing executed by the main controller 10 will be described selectively.

Figure 9:
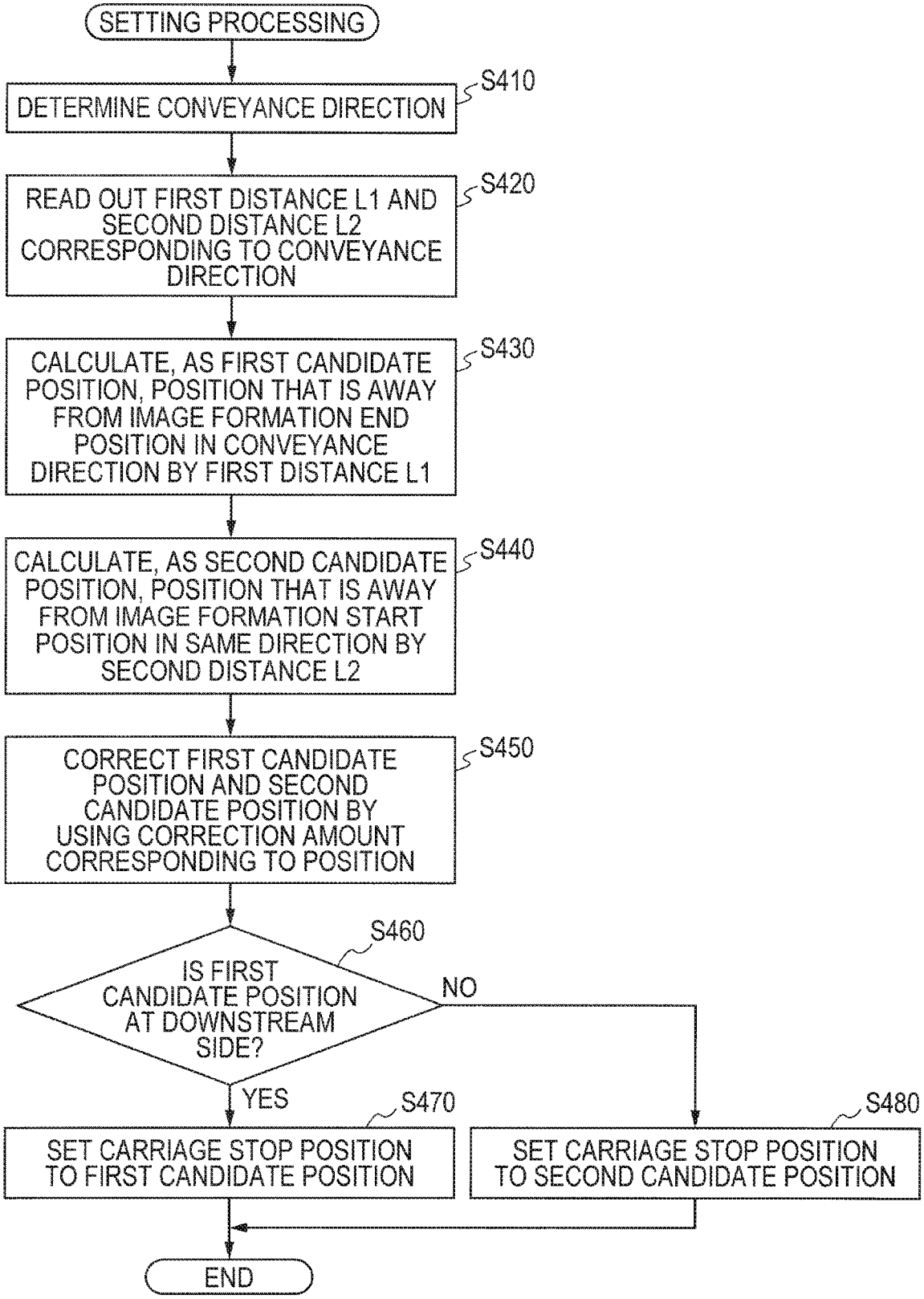
FIG. 9 is a flowchart showing setting processing according to a third embodiment.

Upon starting the setting processing shown in FIG. 9 in S140 (FIG. 3), the main controller 10 determines the conveyance direction of the carriage 61 in the current pass. Specifically, the main controller 10 determines whether the conveyance direction of the carriage 61 is a forward direction (one direction) or a reverse direction (return direction) along the main scanning direction (S410). In the following description, the above-mentioned forward direction is referred to as "main-scanning forward direction", and the reverse direction is referred to as "main-scanning reverse direction".

In S420, the main controller 10 reads out, from the NVRAM 17, the first distance L1 and the second distance L2 based on the conveyance direction of the carriage 61 determined as described above. In a case where the conveyance direction of the carriage 61 is the main-scanning forward direction, the main controller 10 reads out, from the NVRAM 17, the first distance L1 and the second distance L2 for the main-scanning forward direction (forward-direction first distance and forward-direction second distance). In a case where the conveyance direction of the carriage 61 is the main-scanning reverse direction, the main controller 10 reads out, from the NVRAM 17, the first distance L1 and the second distance L2 for the main-scanning reverse direction (reverse-direction first distance and reverse-direction second distance).

As can be understood from the above description, in the present embodiment, the NVRAM 17 preliminarily stores the first distance L1 and the second distance L2 for the main-scanning forward direction and the first distance L1 and the second distance L2 for the main-scanning reverse direction. The NVRAM 17 stores appropriate values of the first distance L1 and the second distance L2 for each direction that are derived from experiments. The combination of the first distance L1 and the second distance L2 for each direction has a relationship that the second distance L2 is longer than the first distance L1.

After that, the main controller 10 calculates, as a first candidate position, a position away from the image formation end position of the current pass by the first distance L1 read out in S420 to the downstream side in the conveyance direction of the carriage 61 (S430). The main controller 10 further calculates, as a second candidate position, a position away from the image formation start position of the next pass by the second distance L2 read out in S420 in the same direction (S440).

Further, the main controller 10 corrects the first candidate position to a position shifted by a load correction amount C(X1) corresponding to the first candidate position X1, and corrects the second candidate position to a position shifted by a load correction amount C(X2) corresponding to the second candidate position X2 (S450).

The load correction amount C(X) is a correction amount for the first candidate position or the second candidate position when the first candidate position or the second candidate position is a position X. The load correction amount C(X) is preliminarily determined for each combination of the position and the conveyance direction of the carriage 61, and is stored in the NVRAM 17.

That is, in S450, the main controller 10 reads out the load correction amount C(X1) corresponding to the combination of the carriage conveyance direction of the current pass and the first candidate position X1, and the load correction amount C(X2) corresponding to the combination of the carriage conveyance direction of the current pass and the second candidate position X2, and corrects the first candidate position X1 and the second candidate position X2.

Figure 10A:
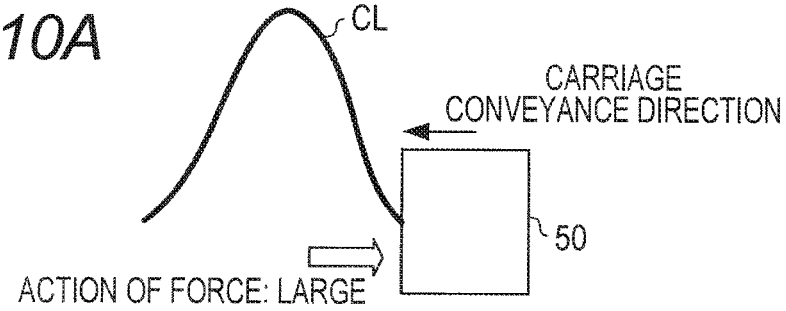
FIGS. 10A and 10B are explanatory diagrams for illustrating force that is exerted on the carriage from a connecting line.
Figure 10B:
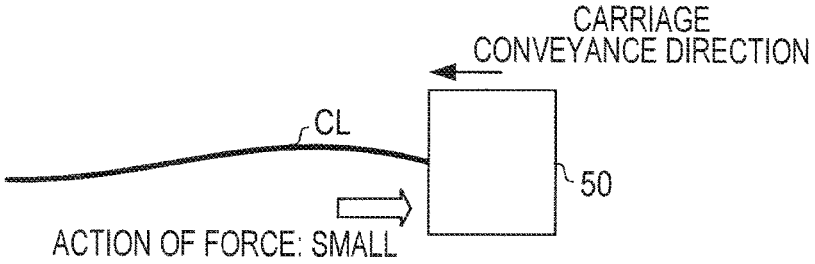

The reason why the load correction amount C(X) is set for each position and carriage conveyance direction is that a signal line for driving the recording head 50 and an ink supply line for supplying ink to the recording head 50 are connected to the recording head 50 mounted on the carriage 61. FIGS. 10A and 10B schematically show that deflection of a connecting line CL changes depending on the position of the carriage 61. It may be understood that the connecting line CL shown in FIGS. 10A and 10B schematically shows the signal line and the ink supply line.

The connecting line CL connected to the recording head 50 exerts external force caused by deflection on the recording head 50. Due to this force, the load exerted on the CR motor 71 changes, and the stop accuracy of the carriage 61 changes.

The magnitude of force that is exerted by the connecting line CL on the recording head 50 changes depending on the deflection amount of the connecting line CL. The force exerted on the recording head 50 is larger when deflection of the connecting line CL is large as shown in FIG. 10A, than when deflection of the connecting line CL is small as shown in FIG. 10B. Thus, the stop accuracy of the carriage 61 changes depending on the stop position of the carriage 61. Further, the stop accuracy changes depending on the relationship between the direction of force exerted by the connecting line CL on the carriage 61 and the conveyance direction of the carriage 61. Hence, in the present embodiment, the load correction amount C(X) is set for each position and direction.

Upon correcting the first candidate position and the second candidate position in S450, the main controller 10 determines whether the first candidate position is located at a farther downstream side in the conveyance direction than the second candidate position is based on the corrected first candidate position and second candidate position (S460). When a positive determination is made (S460: Yes), the carriage stop position is set to the first candidate position (S470). When a negative determination is made (S460: No), the carriage stop position is set to the second candidate position (S480). After that, the setting processing ends.

According to the present embodiment, in an environment in which the load exerted on the recording head 50 and the carriage 61 changes depending on the position in the main scanning direction, the main controller 10 corrects the first distance L1 and the second distance L2 based on the image formation end position and the image formation start position. Specifically, the main controller 10 corrects the first candidate position and the second candidate position based on that position. Thus, the carriage stop position is set in consideration of effects of the stop accuracy depending on the change of the load.

Further, according to the present embodiment, by considering that the control accuracy of the carriage 61 changes depending on the conveyance direction of the carriage 61 and the direction of the external force exerted from the connecting line CL, the first candidate position and the second candidate position are corrected by using the load correction amount C(X) depending on the conveyance direction of the carriage 61.

Thus, it is unnecessary to include large margins in the first distance L1 and the second distance L2 in consideration of the change of the control accuracy, and the carriage 61 can be reciprocated efficiently. Hence, according to the present embodiment, throughput of printing can be improved.

While the disclosure has been described in detail with reference to the above aspects thereof, it would be apparent to those skilled in the art that various changes and modifications may be made therein without departing from the scope of the claims.

For example, the load correction amount C(X) of the third embodiment may be defined for each level of the system usage amount. That is, the idea of correcting the first distance L1 and the second distance L2 based on the system usage amount may be applied to the third embodiment.

A function of one element in the above-described embodiments may be distributedly provided in a plurality of elements. Functions of a plurality of elements may be integrated into one element. A part of the configuration in the above-described embodiments may be omitted. At least part of the configuration in one embodiment may be added to configurations in another embodiment, or may be replaced by a configuration in another embodiment.

The recording head 50 is a non-limiting example of an ejector. The CR motor 71 and the carriage conveyance mechanism 60 are a non-limiting example of a first conveyor. The PF motor 91 and the paper conveyance mechanism 80 are a non-limiting example of a second conveyor. The main controller 10, the print controller 30, and the conveyance controller 40 are a non-limiting example of a controller.

What is claimed is:

1. An image forming system comprising:

an ejector configured to eject ink toward a sheet;

a first conveyor configured to cause the ejector to reciprocate along a main scanning direction;

a second conveyor configured to convey the sheet in a sub-scanning direction; and a controller configured to repeatedly perform operations of controlling the first conveyor to convey the ejector along the main scanning direction to a turn position at which the ejector is stopped for turning, controlling the ejector to eject ink toward the sheet in a conveyance process of the ejector, and controlling the second conveyor to convey the sheet in the sub-scanning direction by a particular amount after ejection of ink by the ejector ends, thereby forming an image on the sheet, the controller being configured to determine which of a first position and a second position is located at a farther downstream side in a moving direction of the ejector and to set a determined position as the turn position, the first position being a first distance away from an image formation end position in the moving direction, the second position being a second distance away from an image formation start position in the moving direction, the image formation end position being an end position of image formation onto the sheet in a conveyance process of the ejector before turning at the turn position, the image formation start position being a start position of image formation onto the sheet in a conveyance process of the ejector after turning at the turn position, the second distance being longer than the first distance.

2. The image forming system according to claim 1, wherein the conveyance process of the ejector comprises accelerating the ejector from a stop position to a particular velocity, moving the ejector at the particular velocity that is a constant velocity, and thereafter decelerating the ejector so as to stop at the turn position that is a next stop position; and wherein the ejection of ink is performed when the ejector moves at the constant velocity.

3. The image forming system according to claim 2, wherein the first distance is obtained by adding a first margin to a standard distance, the standard distance being a distance required for the ejector to accelerate from a stopped state to the particular velocity, the standard distance being a distance required for the ejector to decelerate from the particular velocity to the stopped state; and wherein the second distance is obtained by adding a second margin to the standard distance, the second margin being larger than the first margin.

4. The image forming system according to claim 2, wherein the first distance and the second distance are calculated by expressions L1=D+M1 and L2=D+M1+M2, where L1 is the first distance, L2 is the second distance, D is an acceleration and deceleration distance in design which does not consider a control error, M1 is an error that can occur in an actual stop position of the ejector relative to a target carriage stop position when the ejector is stopped at the target carriage stop position, and M2 is a distance in which the ejector moves from a point where the ejector shifts to a section of the constant velocity until movement of the ejector at the constant velocity becomes stable.

5. The image forming system according to claim 1, wherein the controller is configured to, in an environment where stop accuracy of the ejector changes depending on a usage amount of the image forming system, set the first distance and the second distance based on the usage amount of the image forming system.

6. The image forming system according to claim 5, wherein the usage amount of the image forming system is a value based on at least one of a total operating time from start of usage of the image forming system, a total number of printed sheets, a total conveyance distance of the ejector, and a total number of times of conveyance of the ejector.

7. The image forming system according to claim 1, wherein the controller is configured to, in an environment where a load that is exerted on the ejector in the conveyance process changes depending on a position of the ejector in the main scanning direction, set the first distance and the second distance based on at least one of the image formation end position and the image formation start position.

8. The image forming system according to claim 7, wherein external force is exerted on the ejector from a connecting line connected to the ejector.

9. The image forming system according to claim 1, wherein the ejector is configured to reciprocate in a forward direction and a reverse direction along the main scanning direction;

wherein the first distance for the forward direction is set as a forward-direction first distance, the second distance for the forward direction is set as a forward-direction second distance, the first distance for the reverse direction is set as a reverse-direction first distance, and the second distance for the reverse direction is set as a reverse-direction second distance; and wherein the controller is configured to:

when the ejector is conveyed to the turn position in the forward direction, set the turn position based on the forward-direction first distance and the forward-direction second distance; and when the ejector is conveyed to the turn position in the reverse direction, set the turn position based on the reverse-direction first distance and the reverse-direction second distance.

* * * * *